United States Patent [19]

Palau et al.

[11] Patent Number: 5,031,667

[45] Date of Patent: Jul. 16, 1991

[54] HOOK STRUCTURE TO ACCOMMODATE A PATTERN BOLT FOR A SWINGING LEVER IN A NEGATIVE DOBBY

[75] Inventors: Joseph Palau, Duingt; Jean-Paul Froment, Doussard, both of France

[73] Assignee: S.A. des Establissements Staubli (France), Faverges, France

[21] Appl. No.: 519,672

[22] Filed: May 4, 1990

[30] Foreign Application Priority Data

May 19, 1989 [FR] France ..... 89 06826

[51] Int. Cl.[5] ..... D03C 1/06

[52] U.S. Cl. ..... 139/71

[58] Field of Search ..... 139/71, 68, 72, 74

[56] References Cited

U.S. PATENT DOCUMENTS 4,386,631 6/1983 Mizoguchi ..... 139/71 X
4,557,298 12/1985 Froment ..... 139/71
4,832,087 5/1989 Palau et al. ..... 139/71

FOREIGN PATENT DOCUMENTS 2609476 7/1988 France .

*Primary Examiner*—Andrew M. Falik
*Attorney, Agent, or Firm*—Dowell & Dowell

[57] ABSTRACT

The hooks associated with the swinging levers in a negative dobby of a weaving machine include a notch and opposing bearing face along their inner edges for positively retaining the hub and one arm of a bolt which is selectively actuated to engage each hook.

2 Claims, 2 Drawing Sheets

HOOK STRUCTURE TO ACCOMMODATE A PATTERN BOLT FOR A SWINGING LEVER IN A NEGATIVE DOBBY

FIELD OF THE INVENTION

1. Background of the Invention

The present invention relates to negative dobbies of the type incorporating swinging levers, intended for controlling the heddle frames in weaving looms.

2. Description of the Related Art

French Patent No. 2 609 476 describes an improved negative dobby in which each of the two articulated hooks mounted on each swinging lever cooperates with a pivoting member constituted by a bolt disposed between the bearing face of a hook and the pin on which the hook pivots on the swinging lever.

FIGS. 1 and 2 of the accompanying drawings substantially reproduce FIGS. 3 and 4 of the above-mentioned Application. In FIG. 1, reference 1 designates one of the swinging levers of the dobby, displaced cyclically about its articulation point 2 by the two rear cross-pieces 3, which form bearings for the heel of the hooks 4 articulated at 5 on the ends of said swinging lever 1. The articulation point 2 of the swinging lever 1 is carried by a lever 6 coupled to. The corresponding heddle frame, the displacement of the heddle frame is controlled by a reading device 7 common to all the swinging levers of the dobby.

To that end, with each hook 4 there is associated a two-armed bolt 8 which is articulated on a pin 9 so as to pivot in one direction or in the other under the effect of a pusher 10 actuated by the reading device 7. It should be observed that the pin 9, thus disposed between the pivot 5 of the hook 4 and the bearing face 4*a* of the hook with which the bolt 8 is adapted to cooperate by one of its arms, is located, not strictly on the straight line Y-Z or line of ,force which joins pin 5 and face 4*a*, but in an offset manner (distance d) with respect to Y-Z line towards the outside, i.e. in the direction of the body of the conjugate hook 4, so as to generate a couple or moment of force which tends to rotate the bolt 8 and thus apply the inner face of the hook 4 against the pin 9.

Consequently, a perfectly stable bearing position is obtained. Furthermore and especially, the bolts 8 are subject to compression, so that they may exhibit, in order to withstand equivalent resistant efforts without damage, a reduced mass with respect to the conventional hooks subject to engaging movement.

Nevertheless, studies have shown that, whatever the advantages obtained, such a structure still presented appreciable drawbacks in practice.

It should firstly be noted that the retention or engagement of hook 4 on bolt 8 is not positive. Consequently, under the effect of the vibrations inherent in the operation of the dobby, as well as the variations of the return force exerted on each hook 4, there is a considerable risk of untimely unhooking that must be overcome by using additional stops, which are expensive and subject to wear.

Furthermore, the lateral offset d of the pins 9 outwardly with respect to the line of force Y-Z makes it necessary to give the hooks 4 a marked elongated curvature. In fact, taking into account the relative path X between the tip of the hook 4 and the pin 9, it is necessary, in order to avoid any interference, to move the pin 9 away from the bearing face 4*a* and therefore to elongate hook 4 as well as bolt 8. The major portion of each hook 4 is thus spaced from the line of force Y-Z and is subjected to a considerable bending moment which necessitates hook to exhibit a large resistant through it's cross-section. Finally, this results in elongated, expensive and heavy hooks 4 which generate high forces of inertia, which are sources of untimely vibrations.

SUMMARY OF THE INVENTION

It is a principal object of the present invention to overcome these drawbacks, by providing a negative dobby incorporating double swinging levers for a weaving loom, of the type in which each of the ends of each swinging lever is provided with a pin on which is articulated a hook which cooperates with a bolt mounted to pivot on a pin in order to bear, by pivoting under the effect of the reading device of the dobby, against a bearing face of the hook. The dobby is characterized in that each hook presents, on its inwardly facing edge, a notch sectioned to receive the hub of the bolt in order to ensure positive retention, in all directions, of said hook when the bearing face thereof is applied against the bolt.

In fact, the invention consists in providing, at the inwardly facing edge of each hook, a notch sectioned to receive the hub of the corresponding bolt which is thus enveloped, consequently ensuring positive retention of the hook against any risk of unhooking.

BRIEF DESCRIPTION OF THE DRAWINGS

The invention will be more readily understood on reading the following description with reference to the accompanying drawings, in which.

As indicated hereinbefore, FIGS. 1 and 2 reproduce FIGS. 3 and 4 of French Patent No. 2 609 476.

DESCRIPTION OF THE PREFERRED EMBODIMENT

Figure 1:
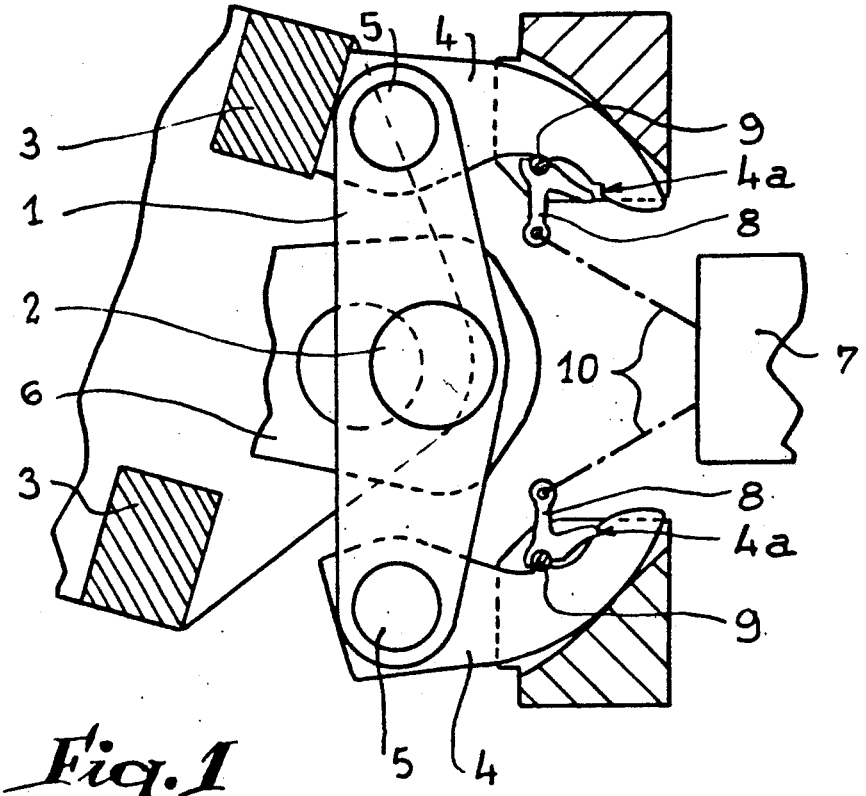
Figure 2:
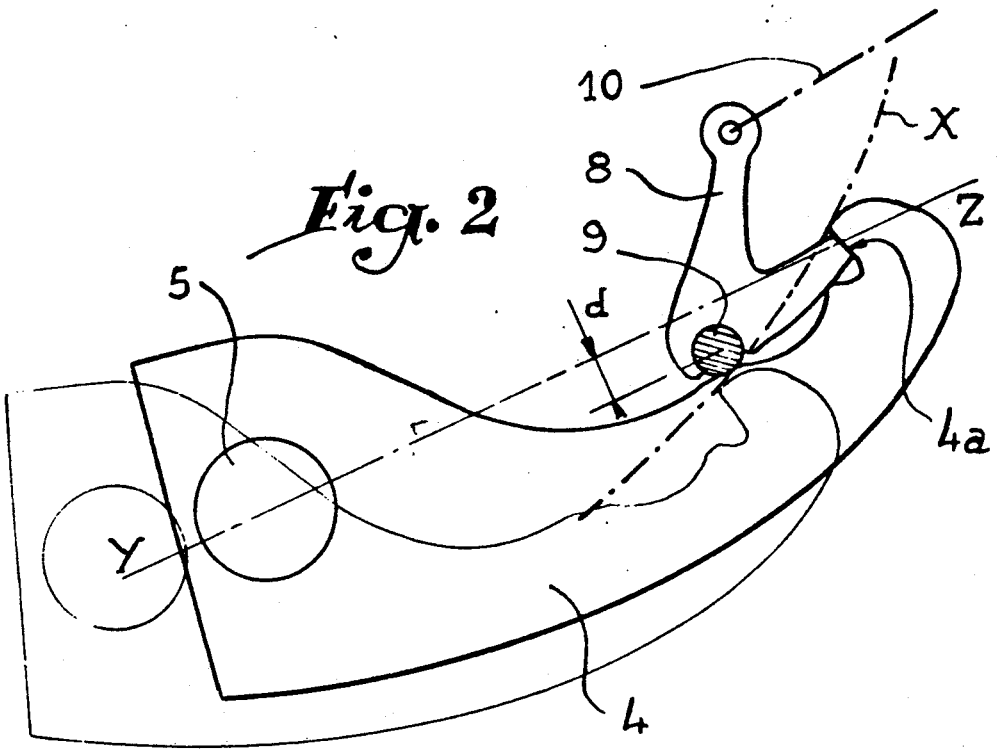
Figure 3:
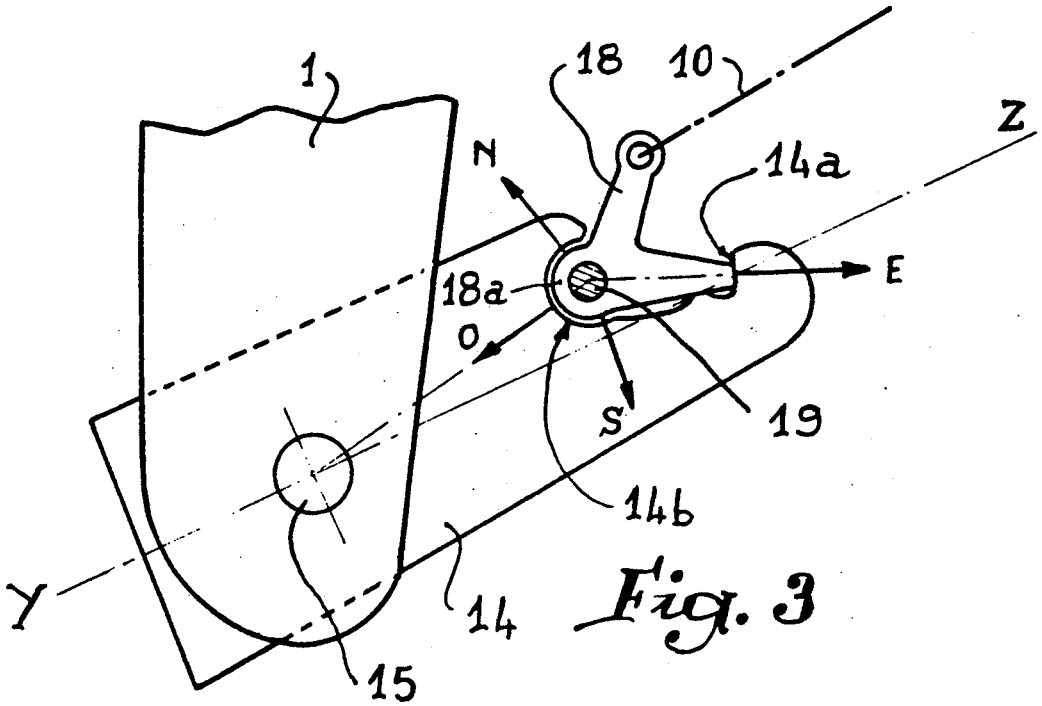
FIG. 3 is a partial side view of a hook/bolt assembly of a dobby according to the invention.
Figure 4:
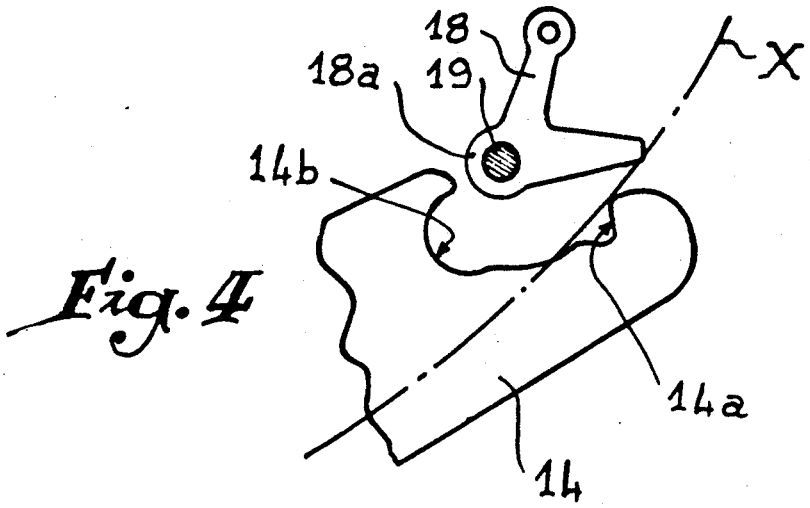
FIG. 4 is a partial side view illustrating the operation of the assembly of FIG. 3.

Referring again to the drawings, in FIG. 3, reference 14 designates one (in fact the lower one) of the two hooks articulated at 15 on the ends of each swinging lever 1. The hook 14 has a bearing face 14*a* adapted to cooperate with the end of one of the two arms of a bolt 18 mounted to oscillate on a pin 19 and connected by a pusher 10 to the reading device, all being as in FIGS. 1 and 2.

However, it should be observed:

on the one hand, that pin 19 is offset inwardly with respect to the line of force Y-Z;

on the other hand, that each hook 14 is sectioned to comprise, on its edge facing the interior of the dobby, a notch 14*b* adapted to envelop the hub 18*a* of the bolt 18 (or at least the pivot pin 19 thereof).

It will be understood that such a structure radically opposes any risk of untimely unhooking of the hook 14 with respect to the bolt 18, whatever the magnitude of the vibrations of the dobby in the course of operation and the variations which affect the efforts to which the hooks 14 are subjected during the weaving operation.

Effectively, despite the direction of offset of pin 19 with respect to the line of force Y-Z, the hook 14 is positively retained in the three orientations N, S and O by the edge of notch 14*b* and, in the fourth orientation E, by the engagement of bearing face 14*a* against the end of the arm of the bolt.

In addition, the reversal of the offset of pin 19 makes it possible to shorten and reduces the weight of both the hooks 14 of the dobby and the bolts 18 associated therewith. As the hooks require a less marked curvature and the length of the bolts is reduced, avoiding any risk of interference along path X of the tip of each hook.

The dimensions of the assembly are consequently reduced, which is always a substantial advantage in the construction of dobbies. The lightweight of the bolts and hooks makes it possible to reduce the inertia exhibited by these moving components and to increase the speed of operation of the dobby, while limiting the efforts developed by the reading device for actuating the pushers 10 associated with the bolts It will be readily imagined that the invention is applicable to dobbies of the type incorporating "drawn swinging levers" in which the reciprocating displacement of each lever 4 is ensured, no longer by thrust crosspieces, but by traction members in the form of hooks mounted to pivot on a beam disposed in front of the swinging levers and connected to the device driving the dobby in order to oscillate alternately in one direction and in the other. The members being controlled by the reading device of the dobby with a view to actuating each swinging lever as a function of the weave of the fabric to be made, in the manner described in U.S. Pat. No. 4 386 631 to MIZOGUCHI.

What is claimed is:

1. In a negative dobby incorporating pairs of opposing swinging levers for a weaving loom of the type in which each end of each swinging lever is provided with a first pivot pin on which is articulated a hook which cooperates with a bolt mounted to pivot on a second pivot pin in order to bear, by pivoting under the effect of a reading device of the dobby, against a bearing face of a hook, the improvement comprising, each hook having an inwardly facing edge, a notch within each inwardly facing edge, each bolt having a hub surrounding the second pivot pin and a pair of arms extending outwardly from said hub, one of said arms having an outer end, each of said notches being of a size and shape to receive said hub of the bolt in order to ensure positive retention of the hook in all directions when the bearing face of the hook engages the outer end of said one of said arms of the bolt.

2. The dobby of claim 1, wherein the second pivot pin for the bolt is offset inwardly in the direction of the articulation of a corresponding swinging lever, with respect to a line of force extending through the bearing face and the first pivot pin of the hook being retained.

* * * * *